US005163075A

United States Patent [19]

Lubinsky et al.

[11] Patent Number: 5,163,075

[45] Date of Patent: Nov. 10, 1992

[54] CONTRAST ENHANCEMENT OF ELECTROGRAPHIC IMAGING

[75] Inventors: Anthony R. Lubinsky, Webster; John W. May, Rochester, both of N.Y.

[73] Assignee: Eastman Kodak Company, Rochester, N.Y.

[21] Appl. No.: 742,123

[22] Filed: Aug. 8, 1991

[51] Int. Cl.[5] ..... G03G 13/044

[52] U.S. Cl. ..... 378/28; 378/32

[58] Field of Search ..... 378/28, 32

[56] References Cited

U.S. PATENT DOCUMENTS 4,038,545 7/1977 Komaki et al. ..... 378/28

4,176,275 11/1979 Korn et al. ..... 378/28

*Primary Examiner*—Constantine Hannaher

*Assistant Examiner*—Don Wong

*Attorney, Agent, or Firm*—William F. Noval

[57] ABSTRACT

The contrast of an electrographic image or a region of interest of an electrographic image having low contrast is enhanced by developing the electrographic image with toner using a development electrode which is biased to a potential which has a value near the average potential of the image but outside of the range of values of potential corresponding to image features selected for enhancement. The voltage potential of the electrographic image is measured to determine the average potential in the region of interest. The development electrode bias is set at a potential near the average potential but outside of the range of potentials corresponding to the image features selected for enhancement in the region of interest of the image. When developed with toner, the toner image has enhanced contrast. If the image is a xeroradiographic image, diagnostic capability of low contrast regions can be enhanced.

6 Claims, 4 Drawing Sheets

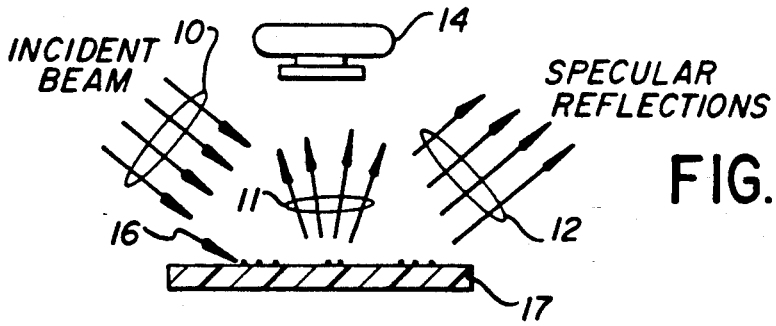
FIG. 3a
FIG. 3b
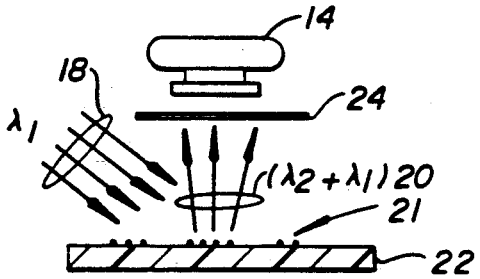
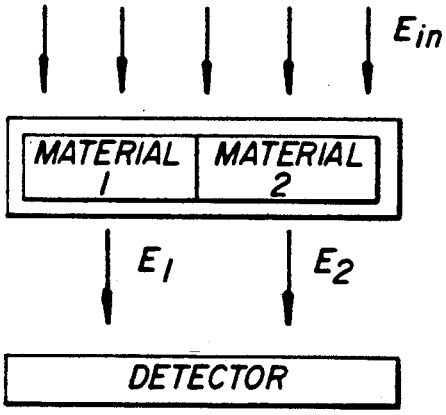
FIG. 4
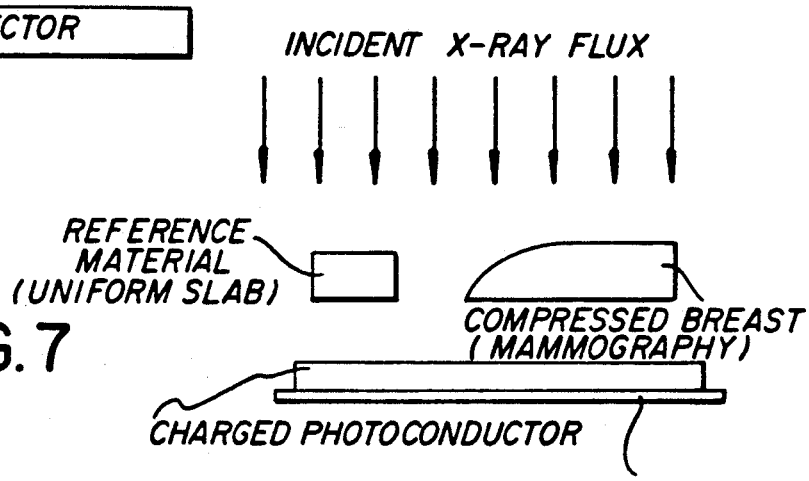
FIG. 7
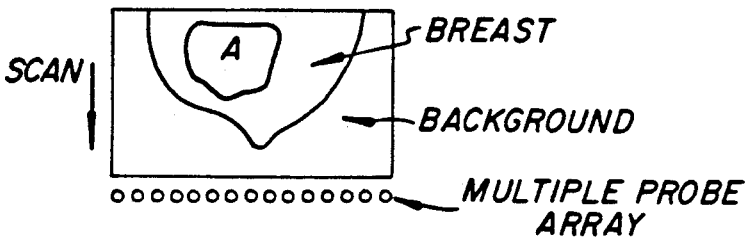
FIG. 8

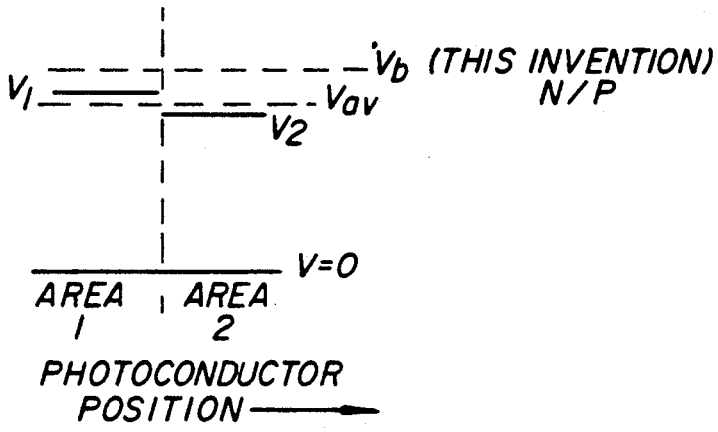
FIG. 5c
FIG. 5d
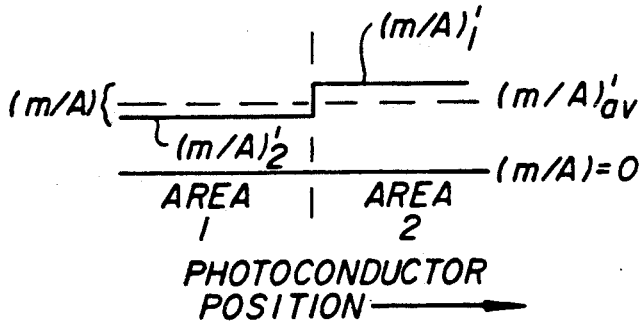

CONTRAST ENHANCEMENT OF ELECTROGRAPHIC IMAGING

TECHNICAL FIELD

The present invention relates, in general, to electrography and more particularly to a technique for enhancing the contrast of electrographic imaging.

RELATED ART

There is a need for improved contrast discrimination in clinical mammography for more reliable diagnosis of breast tumors. In mammography, the image information is contained in the x-ray pattern transmitted by the patient. The noteworthy feature of this pattern is its overall low contrast, which is to say that the exit flux from the main breast area contains relatively small variations of intensity.

Conventional xeroradiography for mammography suffers from the drawback that mainly the fringe electric fields are developed in the latent image, resulting in strong edge enhancement. While useful for high-contrast, high-spatial-frequency portions of an image, e.g. calcifications, conventional xeroradiographic mammography is relatively unsatisfactory for the detection of low-frequency, low-contrast image components such as soft tumors.

On the other hand, conventional film/screen radiography, while better for detection of low-spatial-frequency components and also providing satisfactory response for the higher frequencies, suffers from the drawback of less than optimal ability to discriminate between tissues of similar absorptivities. In the conventional film/screen, image, the scattered flux produces an average gray level in the developed film. Superimposed on this average gray are the weak deviations in density corresponding to the weak imaged contrasts in the imaged breast. Detection of a soft tumor embedded in surrounding soft tissue is therefore difficult, because the corresponding differential film exposures are small compared to the full exposure latitude of the developed film.

There is also a broader need for a technique of enhancing contrast in electrophotographic applications other than xeroradiographic applications. Such other applications include aerial geological surveying; security; extraction of shadow information in positive/positive xerographic imaging and highlight information in negative/positive xerographic imaging; detection of mechanical stress in structural elements, e.g., metals and plastics; radiographic or nonradiographic imaging of biological tissue; etc.

Although it has been proposed to improve an electrophotographic toner image by the use of a biased development electrode during toner development, such proposals have not been successful in improving image contrast in low contrast regions. (See: U.S. Pat. No. 4,176,942, issued Dec. 4, 1979, inventors Tatsumi et al.; U.S. Pat. No. 4,006,709, issued Feb. 8, 1977, inventors Miyakawa et al.; U.S. Pat. No. Re. 31,707, reissued Oct. 16, 1984, inventors Miyakawa et al.; U.S. Pat. No. 4,247,195, issued Jan. 27, 1981, inventors Okamoto et al.) This lack of success is attributable to the biasing of the development electrode at a potential near the background potential of the latent electrostatic image. In addition, the bias potential can have a fixed value rendering it incapable of adapting to changing image conditions and degrading electrophotographic components, such as photoconductor aging.

SUMMARY OF THE INVENTION

It is, therefore, a feature of the present invention to use an improved xeroradiographic method to provide better reliability in diagnosing the presence of tumors, especially in mammography.

It is a further feature of the present invention to provide this improvement at low dosage to the patient, competitive with conventional film/screen methods.

It is yet a further feature of the present invention to provide a means of amplifying weak contrast differences in mammography by separating the image capture and contrast enhancement steps, unlike the conventional film/screen process which has image capture and density formation inseparably linked.

It is yet another feature of the present invention to provide a general method of enhancing contrast in electrophotographic detection for other radiographic or non-radiographic applications. The invention can be used for a pre-selected range of exposure, for a wide range of spatial frequencies (including solid areas), and for localized areas within a larger imaging area. Applications where differential contrast enhancements are useful include: aerial mapping; security; extraction of shadow information in pos/pos xerographic imaging, and highlight information in neg/pos; detection of mechanical stress in structural elements, e.g. in plastics; imaging of biological tissues, etc.

According to an aspect of the present invention there is provided method and apparatus for enhancing the contrast in an electrographic image, especially an image produced by the x-radiation of low contrast bodily tissues. The technique includes measuring the voltage potential of a region of interest of an electrostatic image to determine the average voltage potential and developing the electrostatic image with toner using a development electrode biased at a potential near the average image potential in the region of interest, but outside of the range of values of potential corresponding to image features selected for enhancement.

According to another aspect of the present invention, the toner image is further processed by producing a photographic image thereof. A still further aspect of the present invention includes developing the electrostatic image with luminescent toner and illuminating the toner to produce an emitted light image which can be detected, for example photographed or converted to an electrical image signal through photoelectric scanning techniques.

BRIEF DESCRIPTION OF THE DRAWINGS

FIGS. 3(*a*) and 3(*b*) are diagrammatic views showing post-development imaging techniques which may be used in the present invention.

FIG. 4 is a diagrammatic view showing x-ray exposure of an object.

FIGS. 5(*b*) and 5(*d*) are toner mass per unit area diagrams useful in explaining the present invention.

FIG. 7 is an elevational view showing still another embodiment of the present invention.

FIG. 8 is a plan view showing yet another embodiment of the present invention.

DESCRIPTION OF THE PREFERRED EMBODIMENTS

Figure 1:
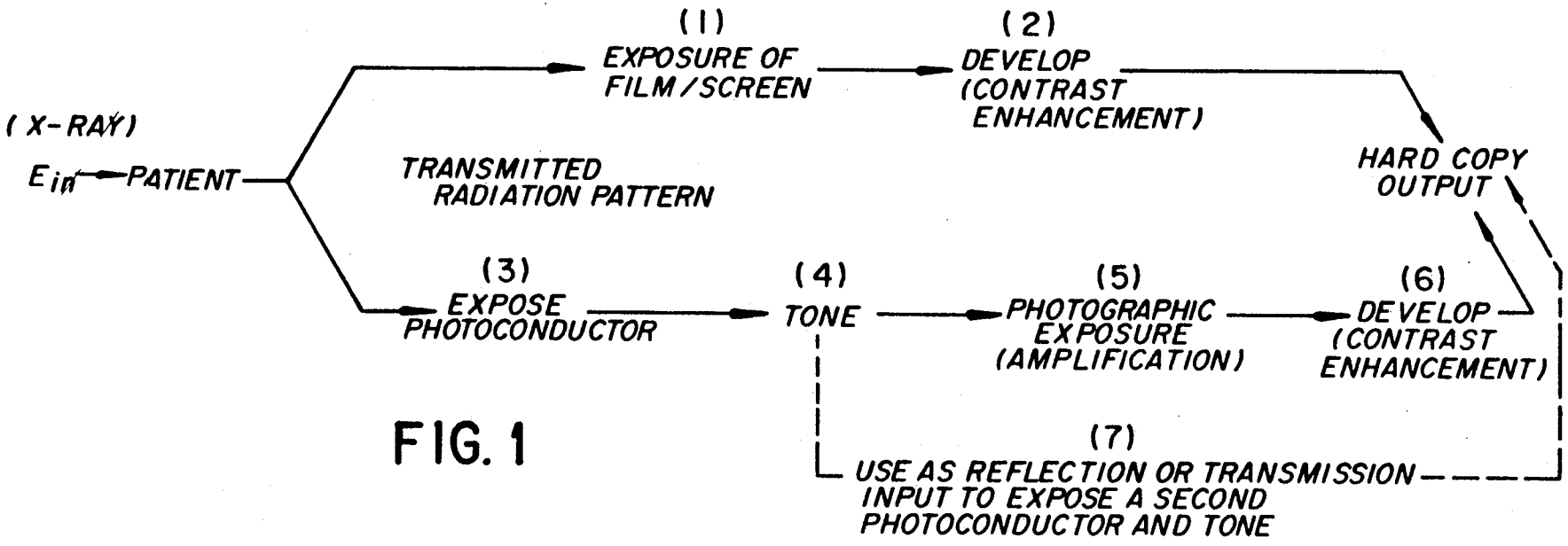
FIGS. 1 and 2 are diagrammatic views useful in explaining the present invention.

The present invention provides a means of circumventing the loss of contrast caused by co-detection of the relatively large average transmitted flux in the film/screen process. This invention also reduces the objectionable effect of object scattering, by a specialized xerographic biasing procedure, described blow. A separate means of recording the resultant toned image may be provided, e.g., by direct photography. While the invention may be considered a hybrid process, in which the xerographic contrast enhancement procedure and the separate subsequent amplification procedure are coupled to produce hard copy output, an advantageous feature of the invention lies in the xerographic processing. Nevertheless, the physical separation of the detection and amplification steps is also a key element in the invention.

The present invention has been successfully employed to enhance imaging in the Luminescent Toner Xeroradiography (LTX) process.

In the LTX imaging process, a luminescent toner image is raster-scanned by a beam of exciting radiation. The digitized emission signals are stored in a computer and subsequently used to drive an output laser scanner to create a hard-copy photographic print. Contrast control in LTX is provided by the algorithm linking luminescent intensity to the light level used to expose the output film, and also by photographic development of the output print.

A simpler and cheaper method of practicing the present invention is to use direct photography of the toned image under blanket illumination. This can be done either in reflection or transmission (with transparent photoconductor). One can also use a luminescent toner with blanket excitation. Related art in U.S. Pat. No. 4,299,904 teaches photographic amplification of a photoluminescent image, but does not disclose the advantageous element of the present invention, which is the special xerographic biasing procedure to be described.

Use of electrophotography to capture a transmitted pattern from a toned mask image on a photoconductor is also a method of amplification, as taught in U.S. Pat. No. 4,256,820 and U.S. Pat. No. 4,278,884. The amplification is rather limited, typically between 2×–4×. Again, the key procedure, i.e. the preparation of the first toner image, is not disclosed in these patents.

In order to clarify the invention in relation to conventional film/screen and conventional xeroradiographic techniques, the process steps for these techniques will be first compared to the process steps of the present contrast-enhancing method for low contrast imaging.

As used in this application, neg/pos development and pos/pos development have the following meanings. Neg/pos development causes toner to be laid down in exposed areas of the photoconductor where the polarities of both the toner particles and the surfaced charges on the photoconductor are the same. Pos/pos development causes toner to be laid down in unexposed areas of the photoconductor and the polarities of toner particles and of surface charges on the photoconductor are opposite.

FIG. 1 shows a comparison of process steps of conventional film/screen mammography with the process steps of the present invention. In the film/screen process, the transmitted x-radiation from the patient causes exposure (1) of the film which is developed (2) to give the output hard copy print. In the present invention, the transmitted x-radiation pattern exposes (3) a photoconductor which is toned (4) using the special biasing method to be described. In the simplest mode, the toned low-density image is photographed (5) using blanket radiation to record the image in reflection or in transmission, or in luminescence from a luminescent toner. The photograph is developed (6) to produce the output print. Step (4) is the advantageous step of the present invention, which gives processing flexibility and an advantage over the film/screen method. A variation of the invention is provided by an alternative recording step (7), in which the toned photoconductor from step (4) is illuminated and the reflected, transmitted or luminescent pattern exposes a photoconductor, which is toned to provide the hard copy output image (the toner may be transferred to a receiver if desired).

Figure 2:
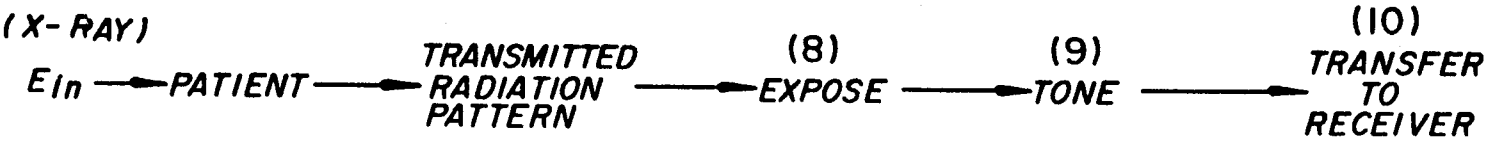

FIG. 2 shows the process steps of conventional xeroradiography in which the transmitted x-ray pattern from the patient exposes (8) a photoconductor, e.g. selenium, which is toned (9) pos/pos (positive to positive) and the toned image transferred (10) to a receiver. Superficially, the sequence of steps (8) and (9) is similar to steps (3) and (4) of the present invention, but there are major differences. In conventional xeroradiography, although a development electrode is used, it is employed very differently from the present invention. The development gap between this electrode and the photoconductor is large, and its function is essentially limited to repelling toner particles to drive them close to the selenium surface, where they are captured by local surface electric fields. This produces so-called fringe-field or edge development, with poor development of low-spatial-frequency features, e.g. solid areas. Nevertheless, because the sensitivity of the developer is high, useful image density can be achieved. On the other hand, the potential of the development electrode is set at a high value so that if complete development were to be carried out, a heavy overall toner deposit would bury the image [A. G. Leiga, in *Imaging Materials,* Seminar Series, Diamond Research Corp., Session 10, June, 1986; L. S. Jeromin and R. C. Speiser, SPIE Vol. 555 Med. Imaging and Instrumentation '85, 127–136, 1985].

In the present invention, however, instead of the few percent of development in conventional xeroradiography, virtually complete development is achieved in the image regions of interest by means of a closely spaced, biased, development electrode. The charge-to-mass of the toner particles is much higher, permitting rapid development. As described by R. M. Shaffert, *Electrophotography,* Chapter III, p. 303 (Focal Press, London, 1965) a closely spaced development electrode provides not only solid area development, but also allows strict electrical control of the post-development surface potential, essential to practice of the present invention. In addition, the low density toned images produced in this invention are not disturbed by either transfer or fusing during the photographic or electrophotographic recording steps (5), (6) or (7).

FIG. 3 illustrates two methods of direct photography of the toned image. In FIG. 3(*a*), a blanket incident beam 10 is angled to illuminate the toned image 16 on a reflective, opaque photoconductor 17, e.g. selenium. Untoned regions produce specular reflections 12 while toned areas produce a scattered, reflected image 11 captured by a camera 14 (or by a charged photoconductor). The toner in this case is not luminescent. It can be specially designed to efficiently reflect and scatter the incident radiation. For a transparent photoconductor, the scattered image can be produced by transmission as well as by reflection. FIG. 3(*b*) shows a luminescent toner image 21 on a photoconductor 22 illuminated by blanket radiation 18 of wavelength $\lambda_1$. The scattered component $\lambda_1$ is blocked by filter 24 and the luminescent emission pattern 20 of wavelength $\lambda_2$ is transmitted by the filter 24 and recorded by camera 14.

To understand further the invention, reference is made to FIG. 4. We consider a case where two objects made of materials with slightly different absorptive properties are embedded in a larger object. A uniform input radiation flux $E_{in}$ is absorbed more strongly in material 1 less strongly in material 2, and the transmitted fluxes $E_1$ and $E_2$ fall upon a detector. Consider first the conventional film/screen process, where exposure of the film results in output densities $D_1$ and $D_2$, respectively, and where the average density lies in the linear portion of the density versus log exposure film response. By definition, the absolute output density difference $\Delta D = D_1 - D_2$, called the density contrast, is given by $$\Delta D_{f/s} = \gamma_{f/s} \Delta \log_{10} E. \quad (1)$$

In equation (1), $\gamma_{f/s}$ is the contrast enhancement factor (gamma) of the film. Evidently, for a given $\Delta\log_{10}E$ determined by the incident dose $E_{in}$ and the radiologic contrast of materials 1 and 2, the output contrast is controlled by the magnitude of gamma.

Figure 5A:
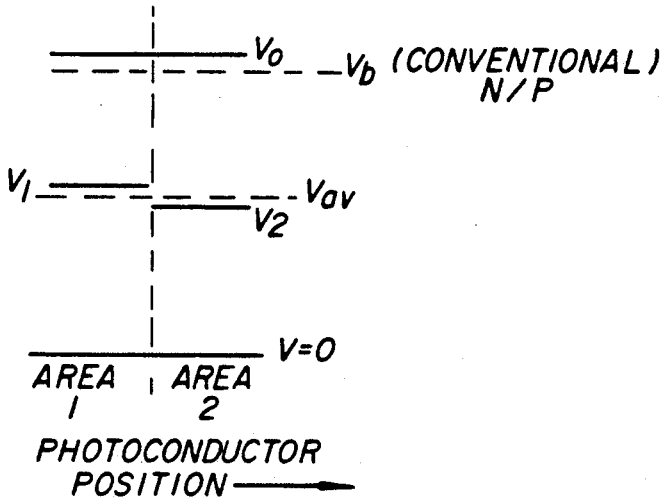
FIG. 5a (PRIOR ART)
FIGS. 5(*a*) and 5(*c*) are voltage potential diagrams useful in explaining the present invention.
Figure 5B:
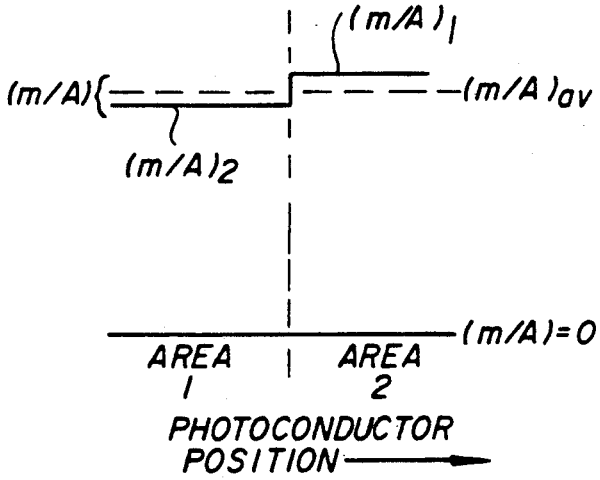
FIG. 5b (PRIOR ART)

Turning to the present invention, the detector is a charged photoconductor at potential $V_o$ prior to exposure. The voltage profile after exposures $E_1$ and $E_2$ is shown in FIG. 5(*a*). The average photodischarge voltage is $V_{av}$. By assumption of low contrast between areas 1 and 2, the corresponding voltages $V_1$ and $V_2$ are close to $V_{av}$ and the differential voltage $(V_1 - V_2)$ is small in magnitude Compared to $V_{av}$. Consider neg/pos development with development electrode biased at potential $V_b$ so as to drive toner into exposed areas of the photoconductor. In standard practice, e.g. imaging of a scene with extended tone scale, $V_b$ will be set as close as practical to $V_o$ so as not to lose shadow information. In standard alphanumeric printing, $V_b$ is similarly set to maximize output density. On the other hand, for conventional pos/pos imaging, $V_b$ will be set close to zero volts so as not to lose highlight information in a scene, and to maximize output density for alphanumerics.

In both standard cases, $(V_b - V_{av})$ is close in magnitude to $(V_o - V_{av})$ and is also much greater in magnitude than $(V_1 - V_2)$. If standard toning methods were used to develop the voltage pattern of FIG. 5(*a*) by conventional setting of the bias $V_b$, the amount of toner proportional to $(V_1 - V_2)$ will be small compared to the amount proportional to $(V_b - V_{av})$. This conventional or standard biasing is analogous to the film/screen method, in which the output density contrast is superimposed on an average gray density of substantial magnitude.

The present invention solves this problem FIG. 5(*c*) by setting the bias level unconventionally at a potential close to $V_{av}$ but outside of the potential range of interest For example, for neg/pos development $V_b$ is set close to $V_1$ (above $V_1$), and for pos/pos development $V_b$ is set close to $V_2$ (below $V_2$). FIGS. 5(*b*) and 5(*d*) indicate toner mass per unit area (m/A) developed on the photoconductor, which for low coverages is proportional to developed voltage. FIG. 5(*b*) indicates $(m/A)_1$, and $(m/A)_2$ and the mean value $(m/A)_{av}$ for conventional development, and FIG. 5(*d*) $(m/A)_1'$, $(m/A)_2'$ and $(m/A)_{av}'$ when $V_b$ is moved closer to $V_{av}$, as described above. The new average mass/area is now $(m/A)'_{av}$, but the difference $(m/A)_1' - (m/A)_2'$ is unchanged and equal to $(m/A)_1 - (m/A)_2$. In other words, the differential toner coverage remains constant for both biasing settings but the average amount of toner is much reduced, i.e. $(m/A)_{av}' < (m/A)_{av}$.

Now consider photographic recording (FIGS. 1 and 3). We have derived for photographic luminescent toner xeroradiography (P-LTX), the result:

$$\Delta D_{P-LTX} = 0.4343\, \gamma_{P-LTX} \cdot \frac{\Delta(m/A)}{(m/A)'_{av}} \quad (2)$$

where $\Delta D_{DP\text{-}LTX}$ is the density contrast on the photographic film having gamma of $\gamma_{P\text{-}LTX}$, $\Delta(m/A)$ is the differential toner coverage on the photoconductor, and $(m/A)'$ is the local average toner coverage. As the development bias potential $V_b$ is brought closer to $V_{av}$, $(m/A)'$ decreases and the output contrast in equation (2) increases. We have also shown that equation (2) can be written:

$$\Delta D_{P-LTX} = \gamma_{P-LTX} \cdot \Delta\log E_{P-LTX} \cdot \frac{(m/A)_{av}}{(m/A)'_{av}} \quad (3)$$

Under ideal conditions of complete development, define contrast enhancement factor F given by:

$$F = \frac{(m/A)_{av}}{(m/A)'_{av}} = \frac{V_o - V_{av}}{V_b - V_{av}} \text{ (neg/pos development)} = \frac{V_{av}}{V_{av} - V_b} \text{ (pos/pos development)} \quad (4)$$

Whereupon from equations (1) and (3) and (4), we obtain $$\frac{\Delta D_{P-LTX}}{\Delta D_{f/s}} = \frac{\gamma_{P-LTX}}{\gamma_{f/s}} \cdot F \quad (5)$$

Equation (5) shows that the output contrast of photographic LTX is enhanced by the factor F multiplied by the ratio of the gammas of the two (possibly different) output films. Similar results apply to non-luminescent photography of a toned image, for either reflection or transmission, where the output film gamma is substituted for $\gamma_{P\text{-}LTX}$ in equations (2)-(5). We now see the gamma of the invention has two factors, the photographic film gamma and the process factor, F.

A numerical comparison with film/screen would use typical F-values exceeding 4, $\gamma_{P\text{-}LTX} = 1.5$, $\gamma_{f/s} = 2.5$, resulting in a contrast improvement factor, computed from equation (5) of more than 2.4 for photographic LTX.

When a second charged photoconductor is used to capture the light pattern from the irradiated toner image (step 7 in FIG. 1), the output density difference on the second photoconductor $\Delta D_{PC}$ depends on the sensitivity of this photoconductor and the sensitivity of the toner used in the second development. The output density difference also depends upon the $D_{max}$ produced which is dependent on the initial potential of the second photoconductor. When the second photoconductor is being used in the large fractional discharge mode, with effective gamma of the developed image given by $\gamma_{PC}$, the situation is completely analogous to the case in equation (2). This results in the analog to equation (5), viz.

$$\frac{\Delta D_{PC}}{\Delta D_{f/s}} = \frac{\gamma_{PC}}{\gamma_{f/s}} \cdot F \tag{6}$$

where $\Delta D_{PC}$ is the differential output contrast of the toned image on the photoconductor.

Evidently, by comparison of equation (6) with equation (5), we have:

$$\frac{\Delta D_{PC}}{\Delta D_{P-LTX}} = \left(\frac{\gamma_{PC}}{\gamma_{P-LTX}}\right) \tag{7}$$

Since typical values of $\gamma_{PC}$ for liquid development using an organic photoconductor are close to 1.5, one finds that xerographic and photographic recording have comparable contrast enhancement abilities.

EXAMPLES

Ex. 1: Photo-LTX, UV excitation of fluorescent toner, using Se photoconductor 150 μm thick, and optical exposure using a phantom image replica as exposure target. $V_b$ series as follows: $(V_b - V_{av}) = 220$, 200, 180, 50 volts, neg/pos development. Areas of low contrast showed dramatic and systematic improvement as $(V_b - V_{av})$ decreased.

Ex. 2: White Light Reflection, non-luminescent, similar to Ex. 1; $V_b$ series showed similar results for same optical exposure target with 150 μm Se photoconductor $(V_b - V_{av}) = 270$, 140, 85, 25 volts.

Ex. 3: X-ray exposures with mammographic phantom, white light reflection photography. $V_b$ series with $V_b - V_{av}$ systematically reduced in a set of images made from identical x-ray exposures showed large improvements in weak contrast areas, including embedded threads, plastic balls, etc.

There will now be described an experimental technique for practicing the invention described above, with particular reference by example to Luminescent Toner Xeroradiography (LTX) as applied to mammography, and to low contrast xerographic recording in general.

In a mammographic x-ray exposure, the transmitted x-ray flux pattern tends to have very low contrast, which is to say that the small differences of absorptivity in the breast tissues result in small differences of amplitude in the transmitted flux pattern. The aforementioned Invention describes setting the development electrode potential in unorthodox fashion so as to enhance the contrast of the toned image.

In the case of neg/pos development, toner is laid down in exposed areas of the photoconductor. The polarites of both the toner particles and the surface charges on the photoconductor are the same. The development electrode bias is set intermediate between the pre-exposure surface potential and the average post-exposure surface potential. In conventional practice, this bias level is close to the pre-exposure potential to retain as much of the exposure information as possible while keeping unexposed background areas free of toner. However, according to the present invention, this bias level is set close to the post-exposure potential.

In the case of pos/pos development, toner is laid down in unexposed areas of the photoconductor. The polarities of toner particles and of surface charges on the photoconductor are opposite. The development electrode bias is set intermediate between the average post-exposure potential and the potential of the support electrode upon which the photoconductive layer is positioned. In conventional practice, this bias level is set close to the potential of the support electrode to retain high $D_{max}$, to retain highlight detail and to prevent deposition of toner on fully exposed areas. However, according to the present invention, the development bias potential is set close to the average post-exposure potential.

To set the development bias experimentally involves the following procedure. After exposure of the photoconductor in an LTX imaging process for mammography, for example, the photoconductor image area corresponding to the imaged breast is scanned by an electrostatic voltmeter probe, e.g. of a TREK Model 344 Electrostatic Voltmeter, manufactured by TREK, Inc., of Medina, N.Y. The scanning operation is a single, non-contacting sweep of the probe across the imaged breast area, thereby producing a record of the post-exposure surface potential on the photoconductor along the track of the probe. This is accomplished either by translation of the probe past the stationary photoconductor, or by translation of the photoconductor past the stationary probe.

A typical high resolution probe resolves 2.5 mm spatial fluctuations of potential on a surface (in a path 2.5 mm wide during the probe sweep described above). The output signals from the probe can be displayed, e.g., on a strip chart recorder, thereby producing a voltage record as a function of probe position during the sweep across the imaged photoconductor. The operator can simply note the excursions of potential about the mean, then set the bias potential of the development electrode close to the limit of these excursions, as described earlier. The operator must be careful not to clip information contained in the voltage excursions.

In a practical, commercial embodiment, the entire procedure is carried out electronically, as follows. The potentials as read by the probe are digitized and stored in a computer in real time. The average post-exposure potential and the variance of the post-exposure potential are easily obtained from the stored data in the computer. The standard deviation can also be calculated. Let this standard deviation, measured in volts, be $\sigma_v$ and let the mean post-exposure potential be $V_{av}$. The development bias potential $V_b$ is then automatically set at a voltage which is a predetermined (operator entered) multiple of $!_v$ away from $V_{av}$. Let this multiple be n.

Figure 6:
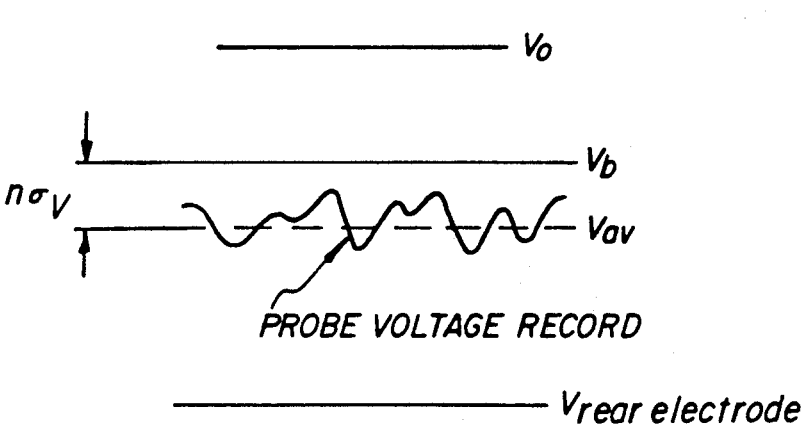
FIG. 6 is a voltage potential diagram useful in explaining another embodiment of the present invention.

As an example, consider a neg/pos process using positive corona charging and positive toner particles. The bias potential is set as:

$$V_b = V_{av} + n.\sigma_v \tag{8}$$

and according to the invention, $n.\sigma_v$ may be much smaller than $(V_o - V_{av})$, where $V_o$ is the potential of an unexposed area of the photoconductor (not sensed by the probe in the sweep described above). A typical value of n would be in the range 2 to 3 for the LTX process, as sketched in FIG. 6.

In a variation of the method (as shown in FIG. 7), a small area of reference x-ray absorbing material having absorptivity and total absorption similar to the breast being examined is placed in the x-ray direct flux between the x-ray source and the photoconductor. When the breast is imaged, a record is also transmitted by the uniform thickness of reference material. When the line scan of the electrostatic probe is made of the surface potential corresponding to the area of the imaged breast on the photoconductor, a simultaneous or sequential voltage record can then be measured in the area corresponding to the reference material, using either the same probe or another probe. The reference voltage $V_{ref}$ is then used to set the development electrode bias for a neg/pos process as follows:

$$V_b = V_{ref} + V_{offset} \quad (9)$$

where $V_{offset}$ is a predetermined voltage set by experience in the mammographic LTX process. This simpler procedure, which can be automatic in a commercial embodiment, does not require the real time computer processing described in the first embodiment above. $V_{offset}$ can, of course, be manually entered by an operator. One may also use the measured and computed $V_{av}$, plus a preselected $V_{offset}$ to generate $V_b$.

Multiple parallel scans can be employed to improve the accuracy of measurement of both $V_{av}$ and $\sigma_v$ used in equation (8). Several probes, or a linear cross-track array of probes can be used to measure the post-exposure surface potential along parallel tracks on the photoconductor. The area scanned can be preselected to record only those parts of the image known in advance to be representative of the average area of interest.

An improvement over the simple scanning via multiple probes is to use a set of probes that effectively scan the entire image area, e.g. for mammography this would entail the entire breast plus surrounding area. The data obtained from such a cross-track linear array of probes can be displayed on a video screen as an image of the breast, and its outline. An operator, using a mouse or electronic pointer, would outline an area A, as indicated in FIG. 8, to be used to generate the $V_{av\ and\ \sigma}$ information. This image on the screen would be retained in the computer for future reference. Artificial intelligence could also be used to locate the breast outline and automatically select area A. The method described in this paragraph prevents errors due to faulty orientation of the patient or faulty orientation of the imaged, undeveloped photoconductor.

ADVANTAGES AND INDUSTRIAL APPLICATION

The present invention has several advantages. Small contrast differences in an electrographic image are enhanced by the development technique of the invention. An improved xeroradiographic method is provided which has better reliability in diagnosing the presence of tumors, especially in mammography, and which allows low x-ray dosage to the patient. The invention has applications in xeroradiography; electrophotographic applications where contrast enhancement is useful such as aerial mapping; security; detection of mechanical stress in structural elements; imaging of biological tissues.

What is claimed is:

1. A method for enhancing the contrast of an electrographic image comprising:

providing an electrostatic image on a support;

measuring the voltage potential of at least a region of interest of said electrostatic image to determine the average voltage potential of at least said region of interest; and developing the electrostatic image with toner using a development electrode biased at a potential near the average image potential in the region of interest, but outside of the range of values of potential corresponding to image features selected for enhancement in said region of interest, so that said electrostatic image in the region of interest is developed to produce a toner image having enhanced contrast in said region of interest.

2. The method of claim 1 wherein said providing an electrostatic image includes exposing a charged photoconductor to x-radiation which has passed through an object to form an electrostatic image of said object on said charged photoconductor.

3. The method of claim 1 wherein said providing an electrostatic image includes exposing a charged photoconductor to x-radiation which has passed through a human body part to form an electrostatic image of said body part on said charged photoconductor.

4. The method of claim 1 wherein said developed toner image is photographed to produce a photographic print of said toner image.

5. The method of claim 1 wherein said developing step includes developing said electrostatic image with luminescent toner to produce a luminescent toner image and including exciting said luminescent toner image to produce an emitted light image and photoelectrically converting said emitted light image to a corresponding electrical image.

6. The method of claim 1 including the steps of illuminating said toner image to expose a s charged photoconductor to produce a second electrostatic image on said photoconductor and developing said second electrostatic image with toner.

* * * * *